US012716625B2

(12) United States Patent
Mori et al.

(10) Patent No.: US 12,716,625 B2
(45) Date of Patent: Aug. 25, 2026

(54) REFRIGERATION CYCLE APPARATUS AND OPTIMIZATION METHOD

(71) Applicants: Mitsubishi Electric Corporation, Tokyo (JP); Mitsubishi Electric Research Laboratories, Inc., Cambridge, MA (US)

(72) Inventors: Yuki Mori, Tokyo (JP); Ankush Chakrabarty, Cambridge, MA (US); Arvind Raghunathan, Cambridge, MA (US)

(73) Assignees: MITSUBISHI ELECTRIC CORPORATION, Tokyo (JP); MITSUBISHI ELECTRIC RESEARCH LABORATORIES, INC.

( * ) Notice: Subject to any disclaimer, the term of this patent is extended or adjusted under 35 U.S.C. 154(b) by 323 days.

(21) Appl. No.: 18/616,336

(22) Filed: Mar. 26, 2024

(65) Prior Publication Data

US 2025/0305733 A1 Oct. 2, 2025

(51) Int. Cl.

| | |
|---|---|
| ***F25B 41/31*** | (2021.01) |
| ***F25B 13/00*** | (2006.01) |
| ***F25B 49/02*** | (2006.01) |

(52) U.S. Cl.

CPC ..... *F25B 41/31* (2021.01); *F25B 13/00* (2013.01); *F25B 49/02* (2013.01);
(Continued)

(58) Field of Classification Search

CPC ..... F25B 41/31; F25B 13/00; F25B 49/02; F25B 2313/0233; F25B 2500/19

See application file for complete search history.

(56) References Cited

U.S. PATENT DOCUMENTS

2015/0234779 A1* 8/2015 Raghunathan ..... G06F 18/2411 708/446
2015/0234780 A1* 8/2015 Raghunathan ..... G06F 18/2411 708/446

(Continued)

FOREIGN PATENT DOCUMENTS

JP 2017-133777 A 8/2017
JP 6910554 B2 7/2021

OTHER PUBLICATIONS

International Search Report issued Dec. 10, 2024 in International Application No. PCT/JP2024/039268, 9 pages.

*Primary Examiner* — Kamini S Shah
(74) *Attorney, Agent, or Firm* — XSENSUS LLP

(57) ABSTRACT

A multi-split type refrigeration cycle apparatus includes a refrigerant circuit including a plurality of expansion valves and a controller to set opening command values for the plurality of expansion valves. The controller sets target openings of the plurality of expansion valves to a plurality of provisional openings, respectively, in an initial step, and determines whether the plurality of provisional openings satisfy an inequality constraint in a first step. When the inequality constraint is not satisfied, the controller fixes one of the provisional openings to an inequality constraint end in a second step, and in a third step, the controller sets again as the provisional openings, points obtained by orthogonally projecting points representing the plurality of provisional openings on an affine hyperplane in a space reduced in order by exclusion of an already fixed provisional opening from the plurality of provisional openings, the affine hyperplane having as an intercept, a subtraction total opening calculated by subtracting the already fixed provisional opening from a total opening, and returns to the first step. When the inequality constraint is satisfied, the controller sets the provisional (Continued)

opening at a current time point as the opening command value in a fourth step.

4 Claims, 13 Drawing Sheets

(52) U.S. Cl.
CPC ... *F25B 2313/0233* (2013.01); *F25B 2500/19* (2013.01); *F25B 2600/2513* (2013.01)

(56) References Cited

U.S. PATENT DOCUMENTS

2021/0215385 A1 7/2021 Mori et al.
2023/0324859 A1* 10/2023 Quirynen ..... G05B 15/02

* cited by examiner

Sp(2)fix=(Sm1pro,Sl2,Su3)

REFRIGERATION CYCLE APPARATUS AND OPTIMIZATION METHOD

TECHNICAL FIELD

The present disclosure relates to a multi-split type refrigeration cycle apparatus in which a plurality of use-side heat exchangers are connected to a heat-source-side heat exchanger and an optimization method applicable to the refrigeration cycle apparatus.

DESCRIPTION OF THE BACKGROUND ART

Background Art

Japanese Patent No. 6910554 (Patent Literature 1) discloses a multi-split type air-conditioner. This air-conditioner includes a refrigerant circuit including a compressor, a heat-source-side heat exchanger, a plurality of expansion valves connected in parallel to the heat-source-side heat exchanger, and a plurality of use-side heat exchangers connected in series to the plurality of expansion valves, respectively. This air-conditioner optimizes distribution of refrigerant in the plurality of use-side heat exchangers by controlling openings of the plurality of expansion valves. Specifically, this air-conditioner calculates optimal opening command values for the plurality of expansion valves by dividing and assigning a total opening of the plurality of expansion valves to the plurality of expansion valves and solving an optimization problem with upper and lower limit openings of the plurality of expansion valves being defined as constraints.

CITATION LIST

Patent Literature

[Patent Literature 1] Japanese Patent No. 6910554

[Patent Literature 2] Japanese Patent Laying-Open No. 2017-133777

SUMMARY OF THE INVENTION

Technical Problem

As described above, the air-conditioner disclosed in Patent Literature 1 calculates the optimal opening command values of the plurality of expansion valves by solving the optimization problem.

Patent Literature 1, however, fails to mention a specific method of solving the optimization problem. If a general method of solving the optimization problem is used, depending on calculation load or calculation accuracy, such a problem as increase in size of a calculator, a longer calculation cycle, or lowering in control performance may arise. In addition, setting of a design parameter may also be required, and increase in design load may also disadvantageously be caused.

The present disclosure was made to solve the problem described above, and an object thereof is to find a solution to an optimization problem applicable to a multi-split type refrigeration cycle apparatus, with high accuracy and with less calculation load.

Solution to Problem (Clause 1) A refrigeration cycle apparatus according to the present disclosure includes a refrigerant circuit including a compressor, a heat-source-side heat exchanger, a plurality of expansion valves connected in parallel to the heat-source-side heat exchanger, and a plurality of use-side heat exchangers connected in series to the plurality of expansion valves, respectively, and a controller to control the plurality of expansion valves such that openings of the plurality of expansion valves are set to a plurality of opening command values, respectively. The controller has a total computing unit to compute a total opening of the plurality of expansion valves, a target computing unit to compute a plurality of target openings representing respective target values of openings of the plurality of expansion valves, a restriction setting unit to set a plurality of restricted ranges defined by lower limit values and upper limit values of the openings of the plurality of expansion valves, respectively, and an optimizer to set the plurality of opening command values by using the total opening, the plurality of target openings, and the plurality of restricted ranges. The target computing unit computes the plurality of target openings such that a total of the plurality of target openings is equal to the total opening. The optimizer, in an initial step, sets the plurality of target openings to a plurality of provisional openings, respectively, in a first step, determines whether an inequality constraint is satisfied, the inequality constraint being that each of the plurality of provisional openings is within a corresponding restricted range, when the inequality constraint is not satisfied, in a second step, computes an upper limit excess indicator and a lower limit excess indicator and compares the upper limit excess indicator and the lower limit excess indicator with each other, the upper limit excess indicator indicating a degree of excess over the upper limit values of the plurality of provisional openings, the lower limit excess indicator indicating a degree of excess over the lower limit values of the plurality of provisional openings, and fixes a provisional opening which deviates most from a limit value larger in indicator to an upper limit value or a lower limit value of the provisional opening, in a third step, sets again as the plurality of provisional openings, points obtained by orthogonally projecting points representing the plurality of provisional openings on an affine hyperplane in a space reduced in order by exclusion of an already fixed provisional opening from the plurality of provisional openings, the affine hyperplane having as an intercept, a subtraction total opening calculated by subtracting the already fixed provisional opening from the total opening, and returns to the first step, repeats processing from the first step to the third step until the inequality constraint is satisfied, and when the inequality constraint is satisfied, in a fourth step, sets the plurality of provisional openings at the time when the inequality constraint is satisfied, as the plurality of opening command values, respectively.

(Clause 2) A refrigeration cycle apparatus according to the present disclosure includes a refrigerant circuit including a compressor, a heat-source-side heat exchanger, a plurality of expansion valves connected in parallel to the heat-source-side heat exchanger, and a plurality of use-side heat exchangers connected in series to the plurality of expansion valves, respectively, and a controller to control the plurality of expansion valves such that openings of the plurality of expansion valves are set to a plurality of opening command values, respectively. The controller has a total computing unit to compute a total opening of the plurality of expansion valves, a target computing unit to compute a plurality of target openings representing respective target values of openings of the plurality of expansion valves, a restriction setting unit to set a plurality of upper limit openings representing respective upper limit values of the openings of the plurality of expansion valves and a plurality of lower limit openings representing respective lower limit values of the openings of the plurality of expansion valves, and an optimizer to set the plurality of opening command values by using the total opening, the plurality of target openings, the plurality of upper limit openings, and the plurality of lower limit openings. The target computing unit computes the plurality of target openings such that a total of the plurality of target openings is equal to the total opening. The optimizer, in an initial step, calculates an adjustment lower limit value vector a, an adjustment upper limit value vector b, and an adjustment target value vector $r_S$ by dividing a lower limit value vector having the plurality of lower limit openings as elements, an upper limit value vector having the plurality of upper limit openings as elements, and a target value vector having the plurality of target openings as elements by the total opening, respectively, sets as a range vector $\lambda_{range}$, a vector obtained by coupling a vector calculated by subtracting the adjustment target value vector $r_S$ from the adjustment lower limit value vector a and a vector calculated by subtracting the adjustment target value vector $r_S$ from the adjustment upper limit value vector b and sorting the vectors in an ascending order, sets as an index vector J, a vector having a first element which is 1 and a second element which is twice as large as the number N of the plurality of expansion valves, and defines an adjustment total range vector h in an expression (12) below

[Epression 1]

$$h = \begin{pmatrix} \sum_{i=1}^{N} \text{clip}\left((r_S[i] + \lambda_{range}[J[1]]), a[i], b[i]\right) \\ \sum_{i=1}^{N} \text{clip}\left((r_S[i] + \lambda_{range}[J[2]]), a[i], b[i]\right) \end{pmatrix}, \tag{12}$$

in a first step, determines whether J[2]–J[1] is equal to or smaller than 1, J[2]–J[1] being a value calculated by subtracting a value of a first element J[1] from a value of a second element J[2] of the index vector J, when J[2]–J[1] is not equal to or smaller than 1, in a second step, sets as a provisional index $J_P$, a value calculated by dropping a fractional portion of an average value of index vectors J and calculates a provisional adjustment total value $h_P$ in an expression (14) below

[Expression 2]

$$h_P = \sum_{i=1}^{N} \text{clip}((r_S[i] + \lambda_{range}[J_P]), a[i], b[i]), \tag{14}$$

in a third step, determines whether the provisional adjustment total value $h_P$ is equal to or larger than 1, when the provisional adjustment total value $h_P$ is equal to or larger than 1, substitutes the provisional index $J_P$ into the second element J[2] of the index vector J, substitutes the provisional adjustment total value $h_P$ into a second element h[2] of the adjustment total range vector h, and returns to the first step, when the provisional adjustment total value $h_P$ is not equal to or larger than 1, substitutes the provisional index $J_P$ into the first element J[1] of the index vector J, substitutes the provisional adjustment total value $h_P$ into a first element h[1] of the adjustment total range vector h, and returns to the first step, repeats processing from the first step to the third step until J[2]–J[1] becomes equal to or smaller than 1, and when J[2]–J[1] becomes equal to or smaller than 1, in a fourth step, calculates a Lagrange multiplier $\lambda^*$ in an expression (16) below

[Expression 3]

$$\lambda^* = \lambda_{range}[J[1]] + (1 - h[1])\frac{\lambda_{range}[J[2]] - \lambda_{range}[J[1]]}{h[2] - h[1]}, \tag{16}$$

and sets an optimal solution calculated in an expression (17) below as the plurality of opening command values

[Expression 4]

$$\text{solution} = S \times \text{clip}(r_S + \lambda^*, a, b). \tag{17}$$

(Clause 3) An optimization method according to the present disclosure causes, when a total value, a restriction vector including an upper limit value and a lower limit value, and a target value vector of which total of elements is equal to the total value are given to a computer or computed by internal computation by the computer, the computer to perform processing including, in an initial step, setting a provisional value vector as the target value vector, in a first step, determining whether an inequality constraint is satisfied, the inequality constraint being that the provisional value vector is within a restricted range defined by a restriction vector, when the inequality constraint is not satisfied, in a second step, computing an upper limit excess indicator and a lower limit excess indicator and comparing the upper limit excess indicator and the lower limit excess indicator with each other, the upper limit excess indicator indicating a degree of excess over an upper limit value of an element of the provisional value vector, the lower limit excess indicator indicating a degree of excess over a lower limit value of the element of the provisional value vector, and fixing an element which deviates most from a limit value larger in indicator to the upper limit value or the lower limit value of the element, in a third step, setting again as the provisional value vector, a point obtained by orthogonally projecting a point representing the provisional value vector on an affine hyperplane in a space reduced in order by exclusion of an already fixed element from the provisional value vector, the affine hyperplane having as an intercept, a subtraction total value calculated by subtracting the already fixed element from the total value, returning to the first step, repeating processing from the first step to the third step until the inequality constraint is satisfied, and when the inequality constraint is satisfied, in a fourth step, outputting as a solution vector, the provisional value vector at the time when the inequality constraint is satisfied, and quitting.

(Clause 4) An optimization method according to the present disclosure causes, when a total value, an upper limit value vector, a lower limit value vector, and a target value vector of which total of elements is equal to the total value are given to a computer or computed by internal computation by the computer, the computer to perform processing including, in an initial step, calculating an adjustment lower limit value vector a, an adjustment upper limit value vector b, and an adjustment target value vector $r_S$ by dividing the lower limit value vector, the upper limit value vector, and the target value vector by the total value, respectively, setting as a range vector $\lambda_{range}$, a vector obtained by coupling a vector calculated by subtracting the adjustment target value vector $r_S$ from the adjustment lower limit value vector a and a vector calculated by subtracting the adjustment target value vector $r_S$ from the adjustment upper limit value vector b and sorting the vectors in an ascending order, setting as an index vector J, a vector having a first element which is 1 and a second element which is twice as large as the number N of elements of the target value vector, and defining an adjustment total range vector h in an expression (12) below

[Expression 5]

$$h = \begin{pmatrix} \sum_{i=1}^{N} \text{clip}((r_S[i] + \lambda_{range}[J[1]]), a[i], b[i]) \\ \sum_{i=1}^{N} \text{clip}((r_S[i] + \lambda_{range}[J[2]]), a[i], b[i]) \end{pmatrix}, \quad (12)$$

in a first step, determines whether J[2]−J[1] is equal to or smaller than 1, J[2]−J[1] being a value calculated by subtracting a value of a first element J[1] from a value of a second element J[2] of the index vector J, when J[2]−J[1] is not equal to or smaller than 1, in a second step, setting as a provisional index $J_P$, a value calculated by dropping a fractional portion of an average value of index vectors J and calculating a provisional adjustment total value $h_P$ in an expression (14) below

[Expression 6]

$$h_P = \sum_{i=1}^{N} \text{clip}((r_S[i] + \lambda_{range}[J_P]), a[i], b[i]), \quad (14)$$

in a third step, determining whether the provisional adjustment total value $h_P$ is equal to or larger than 1, when the provisional adjustment total value $h_P$ is equal to or larger than 1, substituting the provisional index $J_P$ into the second element J[2] of the index vector J, substituting the provisional adjustment total value $h_P$ into a second element h[2] of the adjustment total range vector h, and returning to the first step, and when the provisional adjustment total value $h_P$ is not equal to or larger than 1, substituting the provisional index $J_P$ into the first element J[1] of the index vector J, substituting the provisional adjustment total value $h_P$ into a first element h[1] of the adjustment total range vector h, and returning to the first step, repeating processing from the first step to the third step until J[2]−J[1] becomes equal to or smaller than 1, and when J[2]−J[1] becomes equal to or smaller than 1, in a fourth step, calculating a Lagrange multiplier λ* in an expression (16) below

[Expression 7]

$$\lambda^* = \lambda_{range}[J[1]] + (1 - h[1])\frac{\lambda_{range}[J[2]] - \lambda_{range}[J[1]]}{h[2] - h[1]}, \quad (16)$$

and setting a vector calculated in an expression (17) below as a solution vector and quitting

[Expression 8]

$$\text{solution} = S \times \text{clip}(r_S + \lambda^*, a, b). \quad (17)$$

Advantageous Effects of Invention

According to the present disclosure, a solution to an optimization problem applicable to a multi-split type refrigeration cycle apparatus can be found with high accuracy and with less calculation load.

DESCRIPTION OF THE PREFERRED EMBODIMENTS

Figure 1:
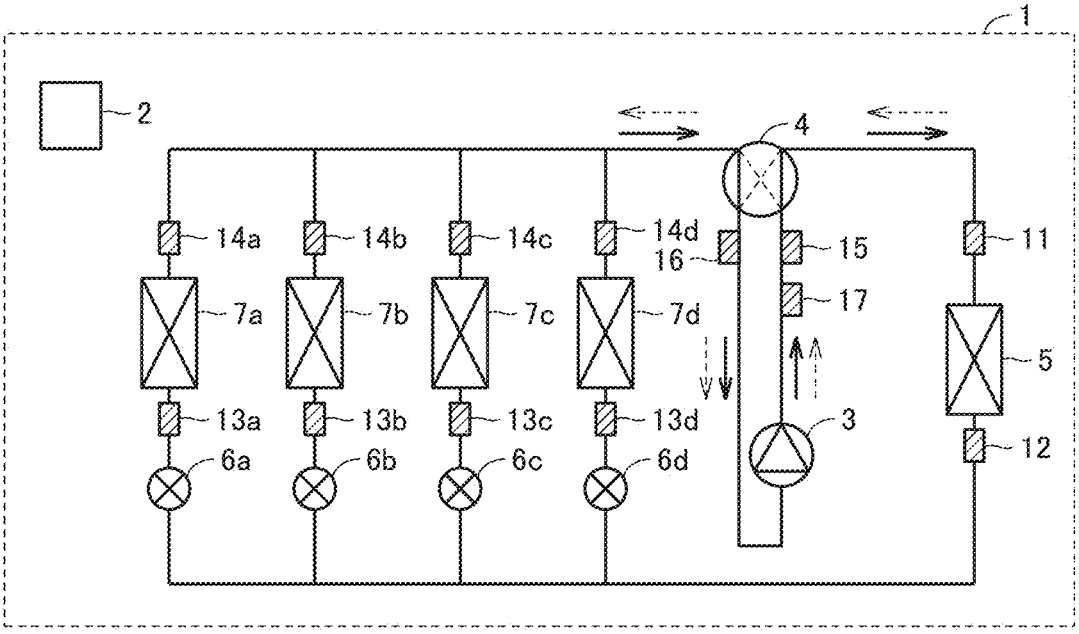
FIG. 1 is a diagram schematically showing an exemplary configuration of a multi-split type refrigeration cycle apparatus.

An embodiment of the present disclosure will be described in detail below with reference to the drawings. The same or corresponding elements in the drawings have the same reference characters allotted and description thereof will not be repeated.

FIG. 1 is a diagram schematically showing an exemplary configuration of a multi-split type refrigeration cycle apparatus 1 according to the present disclosure. Refrigeration cycle apparatus 1 includes a controller 2, a compressor 3, a four-way valve 4, a heat-source-side heat exchanger 5, a plurality of expansion valves 6*a* to 6*d* provided in pipes branched in parallel to one another, and a plurality of use-side heat exchangers 7*a* to 7*d* connected in series to the plurality of expansion valves 6*a* to 6*d*, respectively. A refrigerant circuit is formed by connection of compressor 3, heat-source-side heat exchanger 5, expansion valves 6*a* to 6*d*, and use-side heat exchangers 7*a* to 7*d* through pipes. Refrigerant flows through the refrigerant circuit. Though an example in which refrigeration cycle apparatus 1 is an air-conditioning apparatus will be described below by way of example, refrigeration cycle apparatus 1 is not limited to the air-conditioning apparatus.

Refrigeration cycle apparatus 1 is configured to switch between a cooling operation and a heating operation. In FIG. 1, a solid arrow represents a direction of a flow of refrigerant during the cooling operation and a dashed arrow represents a direction of a flow of refrigerant during the heating operation.

The cooling operation will initially be described. Compressor 3 suctions refrigerant, compresses suctioned refrigerant, and discharges compressed refrigerant. Compressor 3 may be varied in volume (an amount of delivery of refrigerant per unit time period), for example, by freely changing a drive frequency with a not-shown inverter circuit or the like. Four-way valve 4 serves to switch a flow path of refrigerant to make switching between the cooling operation and the heating operation.

During the cooling operation, heat-source-side heat exchanger 5 is provided on a discharge side of compressor 3 and functions as a condenser. The condenser serves for exchange of heat between refrigerant and air, and condenses and liquefies refrigerant and heats air. The plurality of expansion valves 6*a* to 6*d* are provided in pipes between heat-source-side heat exchanger 5 and use-side heat exchangers 7*a* to 7*d* in the refrigerant circuit, respectively. Each of expansion valves 6*a* to 6*d* is implemented, for example, by an expansion valve variable in opening such as an electronic expansion valve, and regulates a pressure and a flow rate of refrigerant. During the cooling operation, use-side heat exchangers 7*a* to 7*d* are provided in pipes on the discharge side of respective expansion valves 6*a* to 6*d* and function as evaporators. The evaporator serves for exchange of heat between refrigerant and air, and evaporates and vaporizes refrigerant and cools air. Vaporized refrigerant is suctioned into compressor 3.

The heating operation will now be described. During the heating operation, refrigerant discharged from compressor 3 flows in a direction shown with the dashed arrow as a result of switching of a refrigerant flow path by four-way valve 4. Refrigerant discharged from four-way valve 4 flows into each of use-side heat exchangers 7*a* to 7*d*. During the heating operation, each of use-side heat exchangers 7*a* to 7*d* functions as the condenser. Heat-source-side heat exchanger 5 is provided in the pipe on the discharge side of expansion valves 6*a* to 6*d* and functions as the evaporator. Operations thereafter are similar to those in the cooling operation.

Refrigeration cycle apparatus 1 includes, for example, temperature sensors 11, 12, 13*a* to 13*d*, 14*a* to 14*d*, and 17 and pressure sensors 15 and 16. Temperature sensor 17 is provided in a discharge pipe of compressor 3 and detects a temperature of refrigerant discharged from compressor 3. Temperature sensor 11 is provided in a pipe on a gas pipe side of heat-source-side heat exchanger 5, and detects a temperature of refrigerant that flows into heat-source-side heat exchanger 5 during the cooling operation and detects a temperature of refrigerant discharged from heat-source-side heat exchanger 5 during the heating operation. Temperature sensor 12 is provided in a pipe on a liquid pipe side of heat-source-side heat exchanger 5, and detects a temperature of refrigerant discharged from heat-source-side heat exchanger 5 during the cooling operation and detects a temperature of refrigerant that flows into heat-source-side heat exchanger 5 during the heating operation. Temperature sensors 13*a* to 13*d* are provided in pipes on the liquid pipe side of respective use-side heat exchangers 7*a* to 7*d*, and detect a temperature of refrigerant that flows into use-side heat exchangers 7*a* to 7*d* during the cooling operation and detect a temperature of refrigerant discharged from use-side heat exchangers 7*a* to 7*d* during the heating operation. Temperature sensors 14*a* to 14*d* are provided in pipes on the gas pipe side of respective use-side heat exchangers 7*a* to 7*d*, and detect a temperature of refrigerant discharged from use-side heat exchangers 7*a* to 7*d* during the cooling operation and detect a temperature of refrigerant that flows into use-side heat exchangers 7*a* to 7*d* during the heating operation. Pressure sensor 15 detects a pressure of refrigerant discharged from compressor 3. Pressure sensor 16 detects a pressure of refrigerant that flows into compressor 3.

Though FIG. 1 illustrates a case in which four use-side heat exchangers 7*a* to 7*d* are connected in parallel to a single heat-source-side heat exchanger 5, the number of use-side heat exchangers 7 (that is, the number of expansion valves 6) to be connected to heat-source-side heat exchanger 5 is not limited to four, and two or three use-side heat exchangers, or five or more use-side heat exchangers may be provided. Furthermore, refrigeration cycle apparatus 1 according to the present disclosure is constructed as being normally controllable even when only a single use-side heat exchanger 7 is connected to heat-source-side heat exchanger 5. This is an important property because operation with a single use-side heat exchanger is required also in the multi-split type refrigeration cycle apparatus. The refrigerant circuit shown in FIG. 1 is a minimum configuration for implementing a refrigeration cycle according to the present disclosure, and may include a capillary tube, an accumulator, a receiver, and the like as necessary. Though the condenser and the evaporator are configured to serve for heat exchange between air and refrigerant, they do not necessarily have to serve for heat exchange with air but may serve for heat exchange with water or underground heat.

Figure 2:
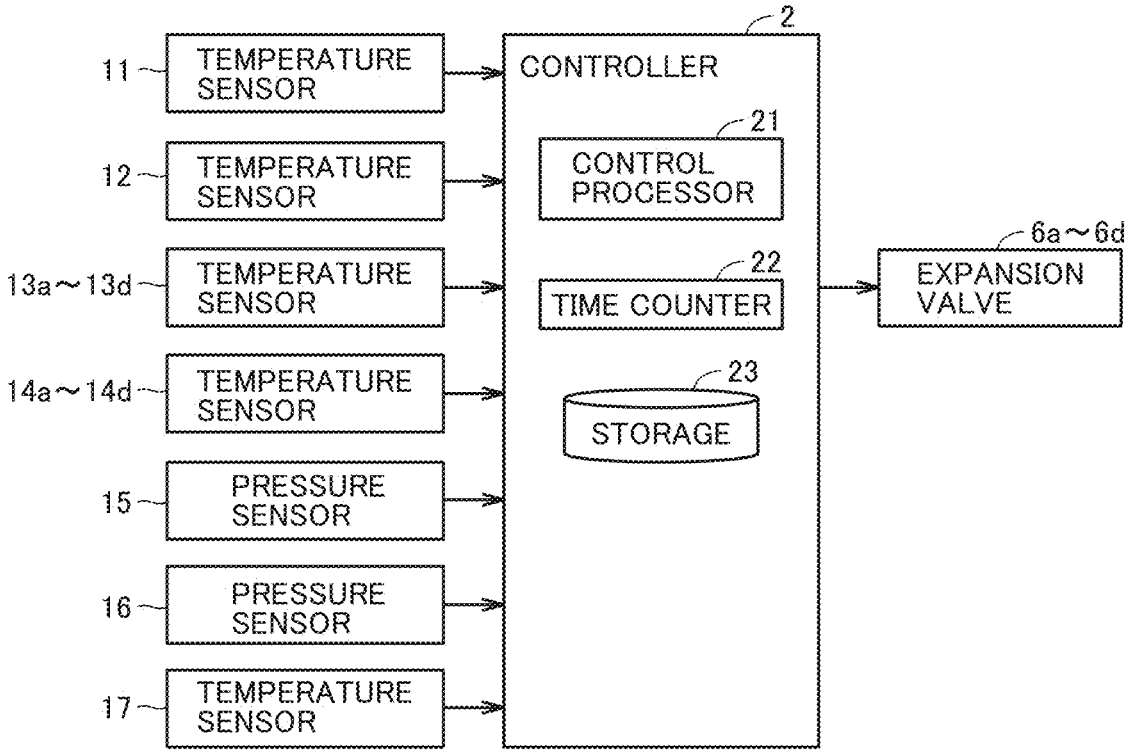
FIG. 2 is a diagram schematically showing a configuration of a controller.

FIG. 2 is a diagram schematically showing a configuration of controller 2. Temperature sensors 11, 12, 13*a* to 13*d*, 14*a* to 14*d*, and 17 and pressure sensors 15 and 16 described above are connected to controller 2, and data on a temperature, a pressure, or the like is inputted thereto from each sensor. In addition, a command or the like from a user is inputted to controller 2 through a not-shown operation portion.

Controller 2 includes a control processor 21, a time counter 22, and a storage 23. Control processor 21 performs processing such as computation, determination, and the like based on inputted data on the temperature or the like, and controls devices of refrigeration cycle apparatus 1 such as compressor 3 and expansion valves 6*a* to 6*d*. Storage 23 is a device where data necessary for processing by control processor 21 is stored. Storage 23 has a volatile memory (not shown) such as a random access memory (RAM) where data can temporarily be stored and a non-volatile auxiliary memory (not shown) such as a hard disk and a flash memory where data can be stored for a long time. Time counter 22 is implemented, for example, by a timer or the like and counts time. Time counter 22 is used for determination or the like by control processor 21.

Control processor 21 can be implemented, for example, by a microcomputer or the like including a computing device such as a central processing unit (CPU). Control processor 21 implements control by performing processing based on data in a program. Control by control processor 21 is not limited to processing by software such as a program but can also be processed by dedicated hardware (electronic circuitry).

Figure 3:
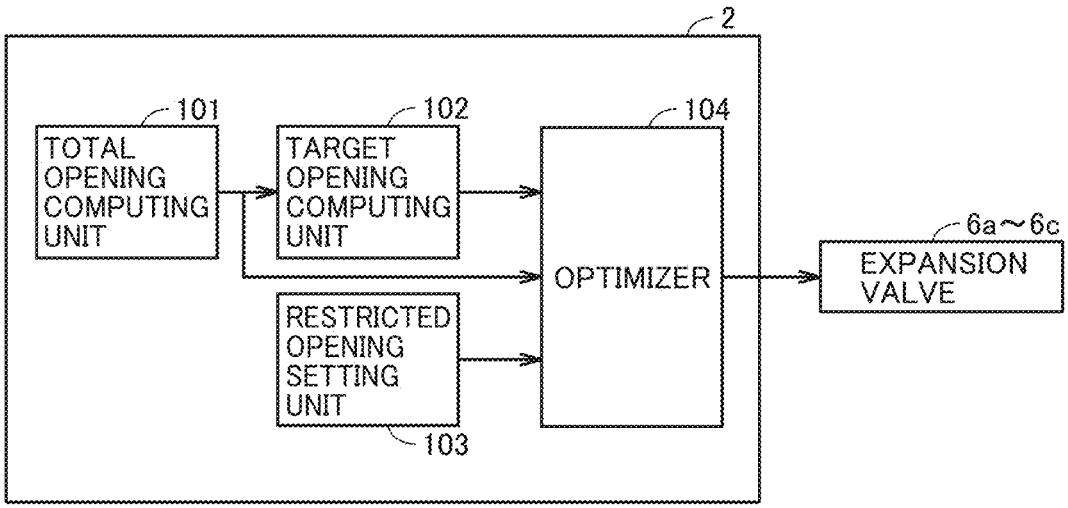
FIG. 3 is a block diagram showing an exemplary configuration of a portion responsible for control of an expansion valve in the controller.

FIG. 3 is a block diagram showing an exemplary configuration of a portion responsible for control of expansion valves 6*a* to 6*d* in controller 2. Controller 2 includes a total opening computing unit 101, a target opening computing unit 102, a restricted opening setting unit 103, and an optimizer 104.

Total opening computing unit 101 computes a total opening St which is a total value of openings of expansion valves 6*a* to 6*d*. Total opening St is computed, for example, by a proportional integral (PI) control unit to control a discharge temperature of compressor 3 to a target discharge temperature. Total opening St is not necessarily limited to a value for control of the discharge temperature, and it may be, for example, a value to control a degree of supercooling or superheat. Alternatively, total opening St may be computed such that at least one of expansion valves 6*a* to 6*d* is closed or opened at a constant speed. Total opening St computed by total opening computing unit 101 is sent to target opening computing unit 102 and optimizer 104.

Target opening computing unit 102 allocates total opening St as openings of four expansion valves 6*a* to 6*d* and computes a plurality of target openings Sm (=Sm1, Sm2, . . . Sm4) representing respective target values of the openings of expansion valves 6*a* to 6*d*. An allocation method may be, for example, equal allocation or unequal allocation. In the case of unequal allocation, for example, allocation is made such that the opening of an expansion valve connected to a use-side heat exchanger larger in volume is larger than the opening of an expansion valve connected to a use-side heat exchanger smaller in volume. An allocation ratio does not have to be set to a constant value but may be set to a variable value that is varied depending on a sensor value or the like. For example, the allocation ratio may be varied such that the opening of an expansion valve connected to a use-side heat exchanger provided in a room small in difference (requested load) between a temperature in the room and a setting temperature is smaller. Alternatively, for example, the allocation ratio may be varied to maintain a degree of superheat or supercooling within an optimal range.

In any case, target opening computing unit 102 sets the sum of target openings Sm (=Sm1+Sm2+ . . . +Sm4) to be equal to total opening St. In addition, each target opening Sm is physically clearly equal to or larger than 0. Target opening Sm computed by target opening computing unit 102 is sent to optimizer 104.

Restricted opening setting unit 103 sets a restricted range of openings of expansion valves 6*a* to 6*d*. Specifically, restricted opening setting unit 103 sets a plurality of upper limit openings Su (=Su1, Su2, . . . Su4) representing respective upper limit values of the openings of expansion valves 6*a* to 6*d* and a plurality of lower limit openings Sl (=Sl1, Sl2, . . . . Sl4) representing respective lower limit values of the openings of expansion valves 6*a* to 6*d*.

Upper limit opening Su and lower limit opening Sl may be set to constant values determined by the upper limit value, the lower limit value, and the like in specifications of the opening of each expansion valve or to variable values that vary with an operating state. When upper limit opening Su and lower limit opening Sl are varied with the operating state, upper limit opening Su and lower limit opening Sl may be varied, for example, to maintain a degree of superheat or supercooling within an optimal range. Upper limit opening Su and lower limit opening Sl are set to satisfy an expression (a) below.

$$0 \le Sli \le Sui \; (i = 1, 2, \ldots 4) \tag{a}$$

Total opening St is set to satisfy an expression (b) below, in connection with upper limit opening Su and lower limit opening Sl.

$$Sl1 + Sl2 + \ldots + Sl4 \le St \le Su1 + Su2 + \ldots + Su4 \tag{b}$$

Upper limit opening Su (=Su1, Su2, . . . Su4) and lower limit opening Sl (=Sl1, Sl2, . . . Sl4) set by restricted opening setting unit 103 are sent to optimizer 104.

Optimizer 104 sets a plurality of command openings S (=S1, S2, . . . S4) representing command values of the openings of expansion valves 6*a* to 6*d* based on total opening St, target opening Sm, and upper limit opening Su and lower limit opening Sl. Specifically, optimizer 104 sets command opening S (=S1, S2, . . . S4) that satisfies first to third conditions below.

(First Condition) The sum (=S1+S2+ . . . +S4) of command openings S is equal to total opening St.

(Second Condition) Each command opening S (=S1, S2, . . . S4) is within the restricted range between upper limit opening Su and lower limit opening Sl corresponding to each command opening.

(Third Condition) Each command opening S (=S1, S2, . . . S4) is closest to target opening Sm corresponding to each command opening, within a range where the first condition and the second condition are satisfied. Being "closest" means that a Euclidean distance is shortest.

In other words, optimizer 104 sets as the command opening, a solution Si (i=1, 2, . . . 4) of an optimization problem shown in an expression (1) below

[Expression 9]

$$\left.\begin{array}{l} \min\limits_{S_i} \sum_{i=1}^{4} (Si - Smi)^2 \\ \text{s.t. } St = \sum_{i=1}^{4} Si \\ Sli \le Si \le Sui \end{array}\right\}. \tag{1}$$

Figure 4:
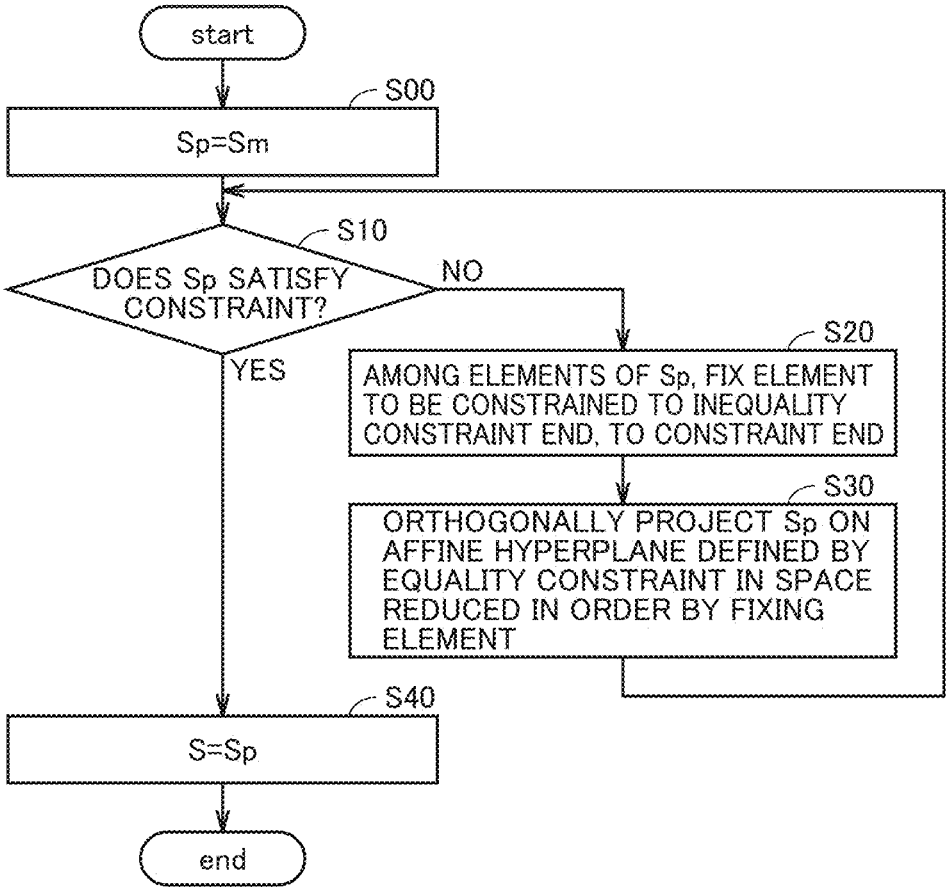
FIG. 4 is a flowchart (No. 1) showing an exemplary procedure of processing by an optimizer.

FIG. 4 is a flowchart showing an exemplary procedure of processing performed by optimizer 104 for efficiently solving the optimization problem shown in the expression (1).

Initially, optimizer 104 makes initial setting of a provisional opening Sp (=Sp1, Sp2, . . . Sp4) to temporarily be used in a process of solving the optimization problem as target opening Sm (=Sm1, Sm2, . . . Sm4) (step S00). Since the sum of target openings Sm is total opening St, the sum of provisional openings Sp at the time of initial setting is also equal to total opening St.

Optimizer 104 then determines whether or not all provisional openings Sp satisfy an inequality constraint shown in the expression (1) above, that is, whether or not each provisional opening Sp is within the restricted range between upper limit opening Su and lower limit opening Sl corresponding to each provisional opening (step S10).

When at least one of provisional openings Sp does not satisfy the inequality constraint (NO in step S10), optimizer 104 computes a lower limit excess indicator A indicating a degree of excess over the lower limit values of all provisional openings Sp and an upper limit excess indicator B indicating a degree of excess over the upper limit values of all provisional openings Sp and compares magnitude thereof, selects an element to be constrained based on a result of comparison, and fixes the element to be constrained to an inequality constraint end (step S20). Specifically, when lower limit excess indicator A is larger than upper limit excess indicator B, optimizer 104 selects an element that deviates most from a lower limit value constraint end (lower limit opening Sl) as the element to be constrained, from among elements of provisional openings Sp that do not satisfy the lower limit value constraint, and fixes the element to be constrained to the lower limit value constraint end of the element. When upper limit excess indicator B is larger than lower limit excess indicator A, on the other hand, optimizer 104 selects an element that deviates most from an upper limit value constraint end (upper limit opening Su) as the element to be constrained, from among elements of provisional openings Sp that do not satisfy the upper limit value constraint, and fixes the element to be constrained to the upper limit value constraint end of the element. Processing in step S20 will also be referred to as "constraint of a solution element" below.

Optimizer 104 then sets again as provisional opening Sp, a point obtained by orthogonally projecting a point representing provisional opening Sp on an affine hyperplane in a space reduced in order by exclusion of the provisional opening already fixed before a current time point from four elements (=Sp1, Sp2, . . . Sp4) of provisional opening Sp, the affine hyperplane having as an intercept, a subtraction total opening $S_{nf}$ calculated by subtracting the already fixed provisional opening from total opening St (step S30). Processing in step S30 will also be referred to as "orthogonal projection" below.

Thereafter, optimizer 104 has the process return to step S10. Optimizer 104 repeats constraint processing in step S20 and orthogonal projection processing in step S30 until all provisional openings Sp are determined as satisfying the inequality constraint in step S10.

When all provisional openings Sp satisfy the inequality constraint (YES in step S10), optimizer 104 sets provisional opening Sp at the current time point as command opening S and quits the process (step S40) because provisional opening Sp at the current time point is the solution to the optimization problem.

FIGS. 5 to 9 are diagrams conceptually showing in a time-series manner, a process of setting of command opening S by repetition of processing in steps S10 to S30 in FIG. 4. FIGS. 5 to 9 show an example in which three command openings S1, S2, and S3 are set (that is, there are three elements to be optimized) with the use of a three-dimensional space defined by three axes y1, y2, and y3 orthogonal to one another for the sake of facilitated understanding. Axes y1, y2, and y3 are coordinate axes representing respective values of command openings S1, S2, and S3.

Figure 5:
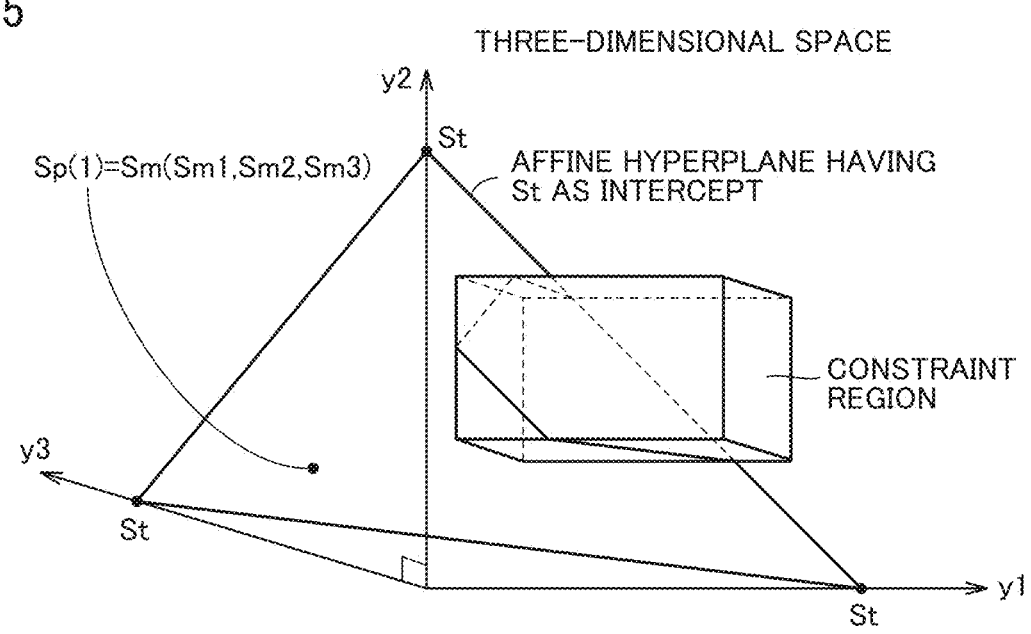
FIG. 5 is a diagram (No. 1) conceptually showing in a time-series manner, a process of setting of a command opening.

Initially, optimizer 104 makes initial setting of target opening Sm (Sm1, Sm2, and Sm3) to a first provisional opening Sp(1) in the three-dimensional space shown in FIG. 5. A constraint region in a shape of a parallelepiped shown in FIG. 5 is a region where the inequality constraint is satisfied, that is, the restricted range between upper limit opening Su and lower limit opening Sl (that is, a range that satisfies conditions of $Su1 \leq y1 \leq Sl1$ and $Su2 \leq y2 \leq Sl2$ and $Su3 \leq y3 \leq Sl3$). In addition, the affine hyperplane having total opening St as the intercept as shown in FIG. 5 is a plane defined by connection of points at which the sum of three command openings S1, S2, and S3 is equal to total opening St. Therefore, search for a point which is arranged on the affine hyperplane, included in the constraint region in the shape of the parallelepiped, and closest to target opening Sm in the three-dimensional space shown in FIG. 5 corresponds to finding of a solution to the optimization problem described above.

Since the sum of three elements Sm1, Sm2, and Sm3 of target opening Sm is equal to total opening St, first provisional opening Sp(1) is arranged on the affine hyperplane having total opening St as the intercept. In the example shown in FIG. 5, however, first provisional opening Sp(1) is located on the outside of the constraint region and does not satisfy the inequality constraint.

Figure 6:
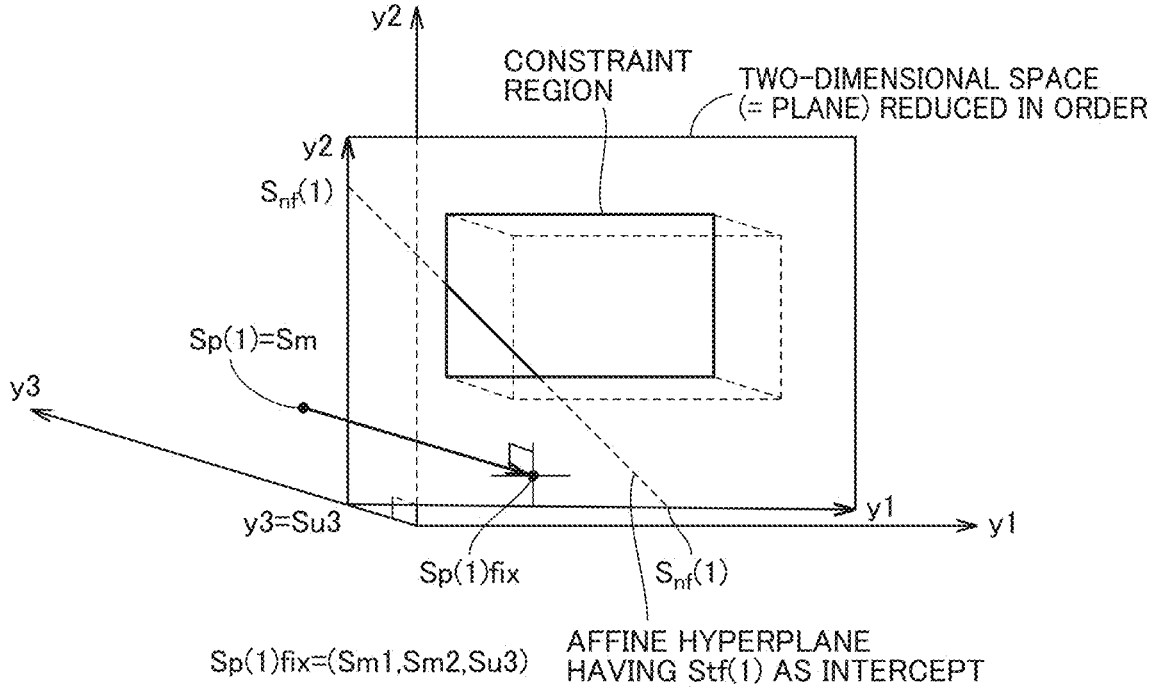
FIG. 6 is a diagram (No. 2) conceptually showing in a time-series manner, the process of setting of the command opening.

The element constrained by constraint of the solution element is element Sm3 among three elements Sm1, Sm2, and Sm3 of provisional opening Sp(1). Therefore, as shown in FIG. 6, optimizer 104 sets a provisional fixed opening Sp(1)fix obtained by fixing element Sm3 of provisional opening Sp(1) to upper limit opening Su3 which is the inequality constraint upper end. Three elements of provisional fixed opening Sp(1)fix are thus (Sm1, Sm2, Su3). Provisional fixed opening Sp(1)fix is a point representing fixed opening Sp(1) in a two-dimensional space (=a y1y2 plane) reduced in order by exclusion of axis y3 of fixed element Sm3 from three axes y1, y2, and y3.

Figure 7:
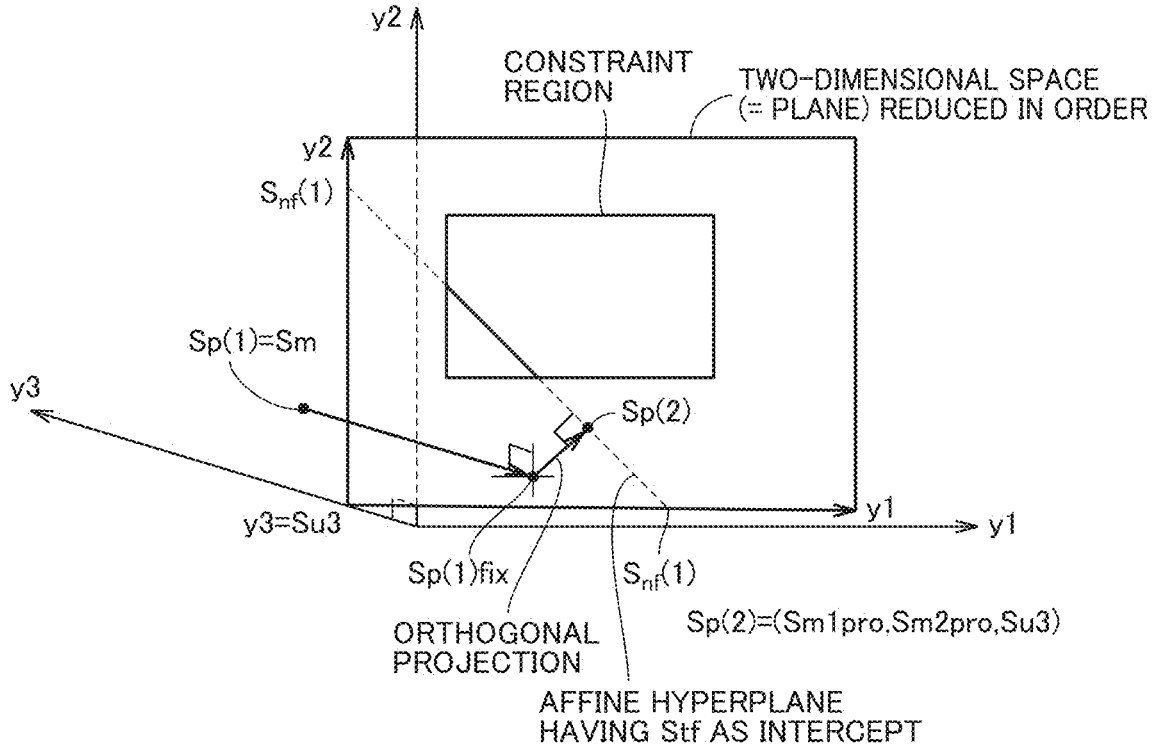
FIG. 7 is a diagram (No. 3) conceptually showing in a time-series manner, the process of setting of the command opening.

As shown in FIG. 7, optimizer 104 then sets as a second provisional opening Sp(2), a point obtained by orthogonally projecting a point representing fixed opening Sp(1) (that is, provisional fixed opening Sp(1)fix) on the affine hyperplane (=straight line) in the two-dimensional space (=the y1y2 plane) reduced in order by exclusion of axis y3 of fixed element Sm3 from three axes y1, y2, and y3, the affine hyperplane having as the intercept, a subtraction total opening $S_{nf}(1)$ calculated by subtracting fixed element Su3 from total opening St. Three elements of second provisional opening Sp(2) are thus a point (Sm1pro, Sm2pro, Su3) shown in FIG. 7.

As shown in FIG. 7, second provisional opening Sp(2) is still located on the outside of the constraint region and does not satisfy the inequality constraint.

Figure 8:
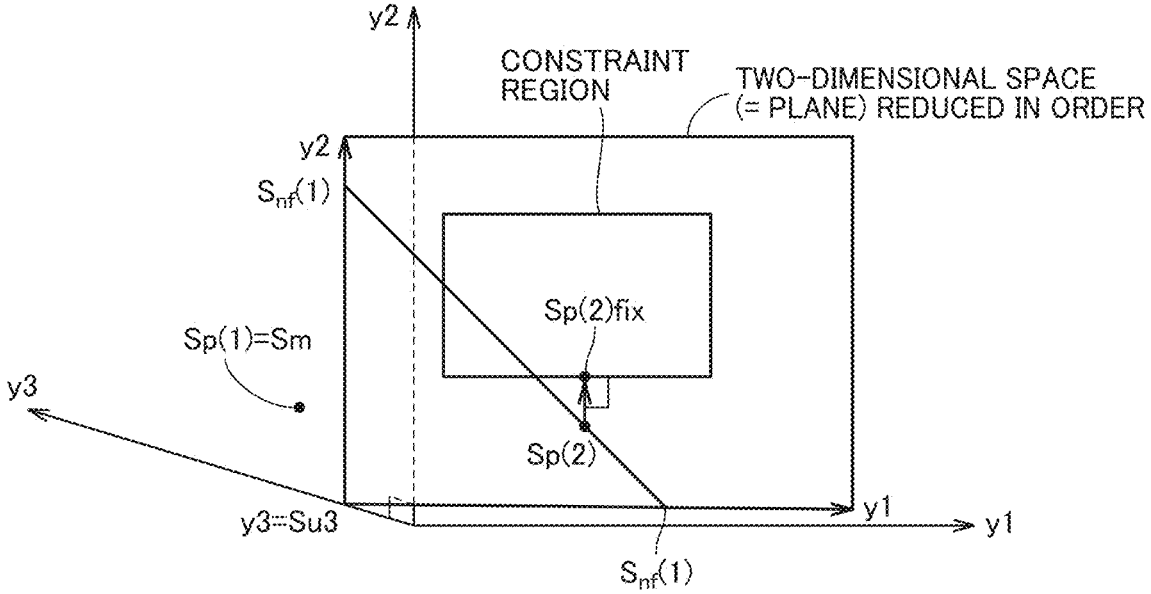
FIG. 8 is a diagram (No. 4) conceptually showing in a time-series manner, the process of setting of the command opening.

Therefore, as shown in FIG. 8, optimizer 104 sets a provisional fixed opening Sp(2)fix obtained by fixing the element Sm2pro which deviates from the constraint region among three elements (Sm1pro, Sm2pro, Su3) of second provisional opening Sp(2) to upper limit opening Sl2 which is the inequality constraint lower end. Three elements of provisional fixed opening Sp(2)fix are thus (Sm1pro, Sl2, Su3).

Figure 9:
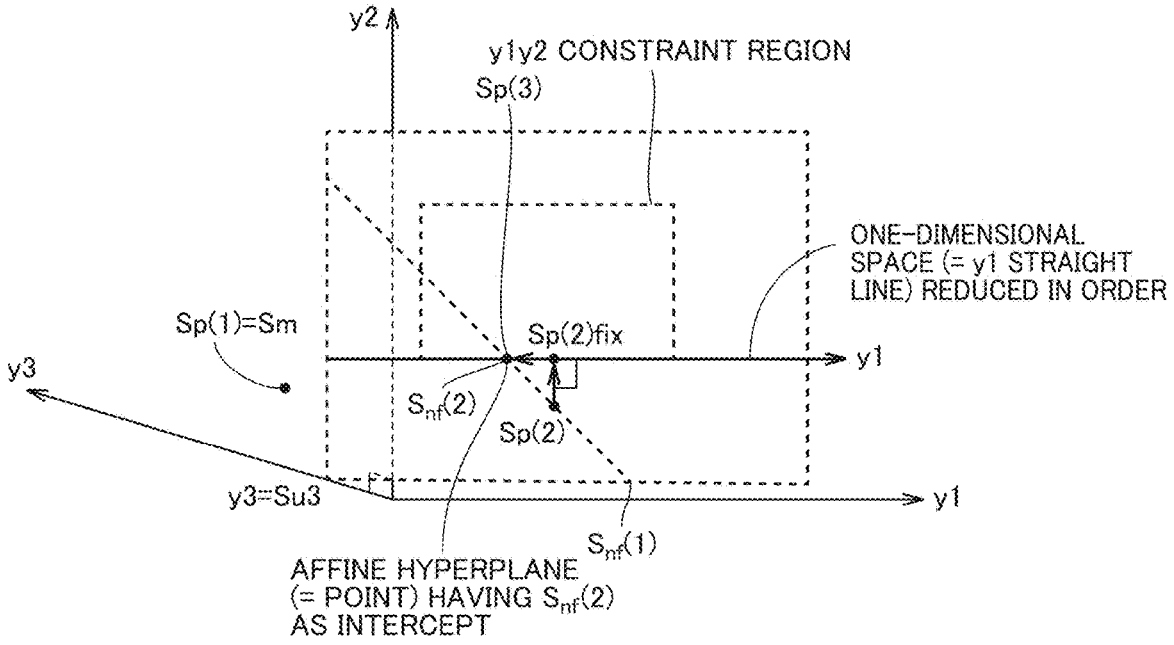
FIG. 9 is a diagram (No. 5) conceptually showing in a time-series manner, the process of setting of the command opening.

As shown in FIG. 9, optimizer 104 then sets as a third provisional opening Sp(3), a point obtained by orthogonally projecting provisional fixed opening Sp(2)fix on the affine hyperplane (=point) in a one-dimensional space (=a y1 straight line) reduced in order by exclusion of two fixed axes y2 and y3 from three axes y1, y2, and y3, the affine hyperplane having as the intercept, a subtraction total opening $S_{nf}(2)$ calculated by subtracting two fixed elements Sl2 and Su3 from total opening St.

As shown in FIG. 9, third provisional opening Sp(3) has the sum of the three elements equal to total opening St and does not deviate from the constraint region, and it is an optimal solution closest to target opening Sm. Therefore, optimizer 104 sets third provisional opening Sp(3) as command opening S and quits the process.

Thus, when there are three elements to be optimized, in the present embodiment, the solution to the optimization problem described above can be found by repeating the constraint processing in step S20 and the orthogonal projection processing in step S30 two times. Generalization in an example where the number of elements to be optimized is "N" can solve the optimization problem described above by repetition of processing in steps S10 to S30 "N−1" times, in the present embodiment.

Figure 10:
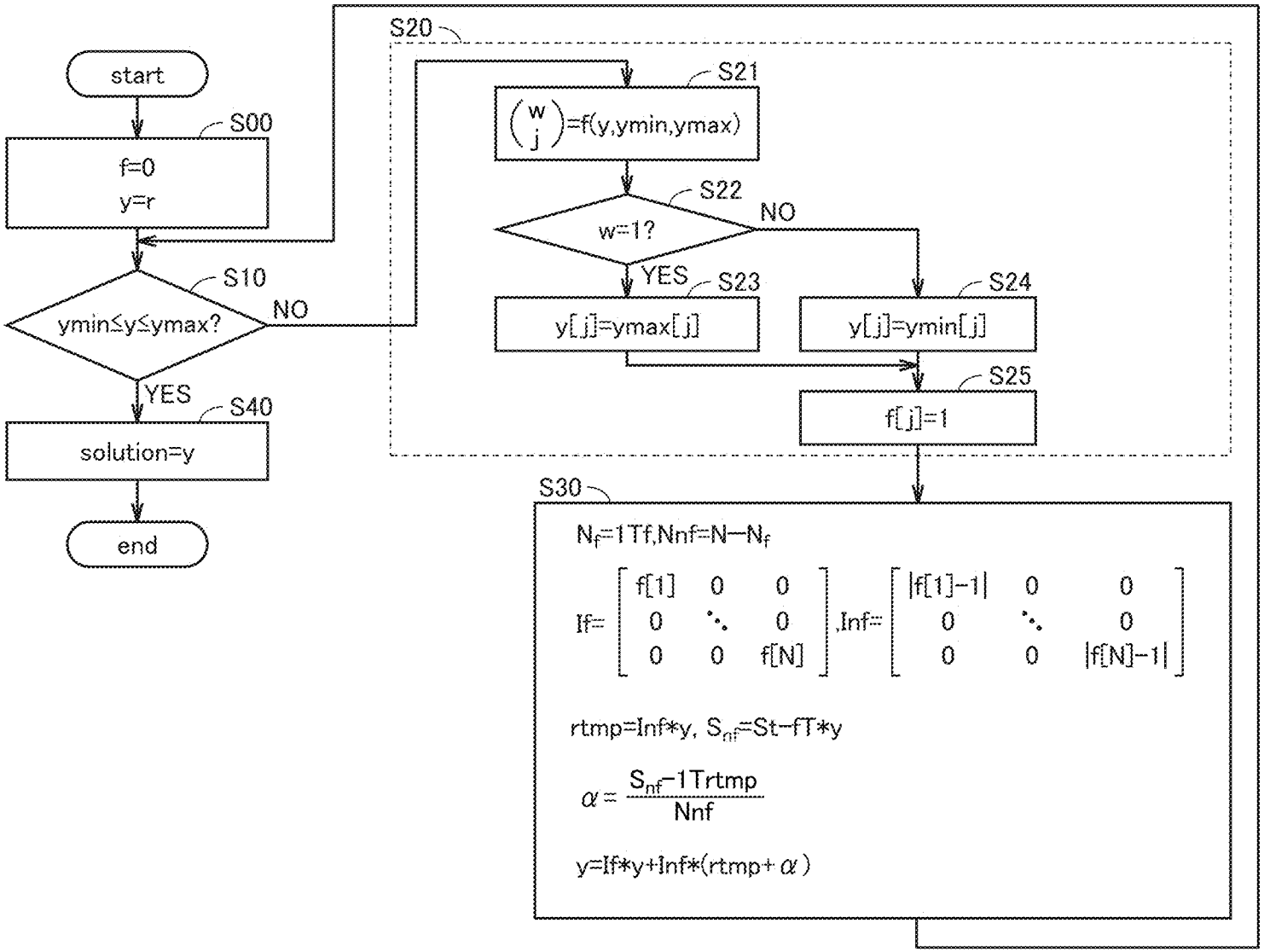
FIG. 10 expresses contents of the processing in the flowchart in FIG. 4 as a mathematical expression.

FIG. 10 expresses contents of the processing in the flowchart in FIG. 4 as a mathematical expression. In FIG. 10, for generalization, a dimension is set to "N". This dimension "N" corresponds to "N" elements (expansion valves) to be optimized.

Initially, in step S00, optimizer 104 makes initial setting of a vector variable f and a provisional solution vector y. Specifically, optimizer 104 sets f and y to f=0 and y=r, respectively. Provisional solution vector y is a vector having provisional opening Sp as the element. "r" is a target opening vector having target opening Sm as the element. Therefore, y=r means setting of provisional opening Sp as target opening Sm. Vector variable f is a vector variable in which an index of an element a solution to which has not yet been determined among elements of provisional solution vector y is defined as "0" and "1" is substituted into an index of an element a solution to which has been determined.

In step S10, optimizer 104 then determines whether or not relation of ymin≤y≤ymax is satisfied, where "ymin" represents a lower limit value vector having lower limit opening Sl as an element and "ymax" is an upper limit value vector having upper limit opening Su as an element. Therefore, "ymin≤y≤ymax" means that all elements of provisional solution vector y satisfy the inequality constraint.

When relation of ymin≤y≤ymax is not satisfied (NO in step S10), in step S20, optimizer 104 determines which of the element that deviates from the upper limit value and the element that deviates from the lower limit value should be constrained, thereafter selects from elements of provisional solution vector y, an element that deviates most from the inequality constraint end on a side determined as the side where constraint should be made, as the element to be constrained, and fixes the element to be constrained, to the inequality constraint end.

Specifically, initially in step S21, processing for determining how manieth element in provisional solution vector y should be constrained and to which of the upper limit and the lower limit the element should be constrained is performed. In step S21, an index j of the element to be constrained and a variable w indicating to which of the upper limit and the lower limit the element should be constrained are set. Details of step S21 will be described later. In next step S22, whether or not "1" indicating that variable w should be constrained to the upper limit has been set is determined. When variable w has been set to "1", y[j]=ymax[j] is performed to constrain the element to the upper limit, that is, an element y[j] to be constrained among elements of provisional solution vector y is fixed to an upper limit ymax[j] (step S23). When variable w has not been set to "1", y[j]=ymin[j] is performed, in other words, element y[j] to be constrained among the elements of provisional solution vector y is fixed to a lower limit ymin[j] (step S24). Furthermore, in any case, f[j]=1 is set in step S25, that is, the index of the fixed element in vector variable f is set to "1".

In step S30, optimizer 104 then sets again as provisional solution vector y, a point obtained by orthogonally projecting a point representing provisional solution vector y on the affine hyperplane in the space reduced in order by exclusion of the element already fixed before the current time point, the affine hyperplane having as the intercept, subtraction total opening $S_{nf}$ calculated by subtracting the fixed element from total opening St. Specifically, optimizer 104 performs computation below in step S30.

Initially, the number $N_f$ of fixed elements and the number $N_{nf}$ of elements that have not been fixed are calculated in a computing equation shown in an expression (2) below

[Expression 10]

$$N_f = 1^T f,\ N_{nf} = N - N_f. \tag{2}$$

Furthermore, a determinant $I_f$ that extracts a fixed element and a determinant $I_{nf}$ that extracts an element that has not been fixed are set as in a computing equation shown in an expression (3) below.

[Expression 11]

$$I_f = \begin{bmatrix} f[1] & 0 & 0 \\ 0 & \ddots & 0 \\ 0 & 0 & f[N] \end{bmatrix},\ I_{nf} = \begin{bmatrix} |f[1]-1| & 0 & 0 \\ 0 & \ddots & 0 \\ 0 & 0 & |f[N]-1| \end{bmatrix} \tag{3}$$

Furthermore, a provisional fixed solution vector $r_{tmp}$ obtained by converting the fixed element of provisional solution vector y to 0 and a subtraction total opening $S_{nf}$ calculated by subtracting the fixed element from total opening St are calculated in a computing equation shown in an expression (4) below.

[Expression 12]

$$r_{tmp} = I_{nf} * y,\ S_{nf} = S_t - f^T * y \tag{4}$$

Then, provisional solution vector y is set again in a computing equation shown in an expression (5) below. Provisional solution vector y set again in the computing equation shown in the expression (5) is a vector that represents the point obtained by orthogonally projecting the point representing provisional fixed solution vector $r_{tmp}$ on the affine hyperplane in the space reduced in order by exclusion of the element already fixed before the current time point, the affine hyperplane having as the intercept, subtraction total opening $S_{nf}$ calculated by subtracting the fixed element from total opening St.

[Expression 13]

$$\left.\begin{aligned} \alpha &= \frac{S_{nf} - 1^T r_{tmp}}{N_{nf}} \\ y &= I_f * y + I_{nf} * (r_{tmp} + \alpha) \end{aligned}\right\} \tag{5}$$

After optimizer 104 sets provisional solution vector y again in computation as above, it has the process return to step S10.

Optimizer 104 repeats processing in steps S20 and 30 until all elements of provisional solution vector y are determined as satisfying the inequality constraint in step S10.

When all elements of provisional solution vector y satisfy the inequality constraint (YES in step S10), optimizer 104 then sets provisional solution vector y at the current time point as the solution to the optimization problem and quits the process (step S40).

Figure 11:
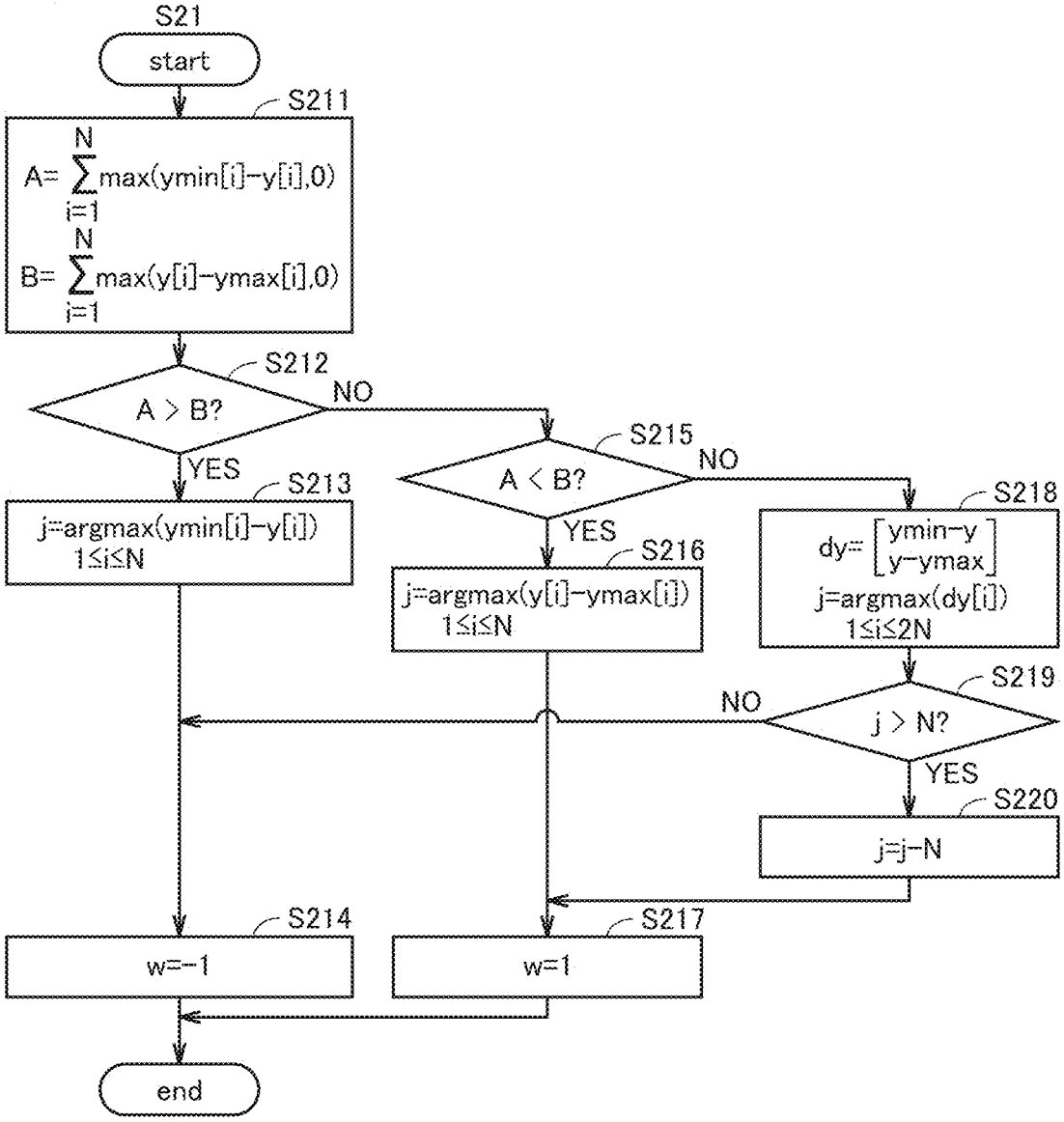
FIG. 11 is a flowchart showing a detailed procedure of processing in step S21 in FIG. 10.

FIG. 11 is a flowchart showing a detailed procedure of the processing (processing for setting index j of the element to be constrained and variable w indicating to which of the upper limit and the lower limit the element should be constrained) in step S21 in FIG. 10.

Initially, optimizer 104 calculates lower limit excess indicator A and upper limit excess indicator B shown in an expression (6) below (step S211)

[Expression 14]

$$\left.\begin{aligned} A &= \sum_{i=1}^{N} \max(y\min[i] - y[i], 0) \\ B &= \sum_{i=1}^{N} \max(y[i] - y\max[i], 0) \end{aligned}\right\}. \quad (6)$$

Optimizer 104 then determines whether or not lower limit excess indicator A is larger than upper limit excess indicator B (step S212).

When lower limit excess indicator A is larger than upper limit excess indicator B (YES in step S212), optimizer 104 sets index j of the element to be constrained in an expression (7) below (step S213)

[Expression 15]

$$j = \underset{1 \le i \le N}{\operatorname{argmax}}(y\min[i] - y[i]). \quad (7)$$

Optimizer 104 then sets variable w to "−1" indicating that the element should be constrained to the lower limit (step S214).

When lower limit excess indicator A is not larger than upper limit excess indicator B (NO in step S212), on the other hand, optimizer 104 determines whether or not upper limit excess indicator B is larger than lower limit excess indicator A (step S215).

When upper limit excess indicator B is larger than lower limit excess indicator A (YES in step S215), optimizer 104 sets index j of the element to be constrained in an expression (8) below (step S213)

[Expression 16]

$$j = \underset{1 \le i \le N}{\operatorname{argmax}}(y[i] - y\max[i]). \quad (8)$$

Optimizer 104 then sets variable w to "1" indicating that the element should be constrained to the upper limit (step S217).

On the other hand, when upper limit excess indicator B is equal to lower limit excess indicator A (NO in step S215), optimizer 104 initially defines an upper/lower limit difference vector dy in an expression (9) below and sets element index j to be constrained in an expression (10) below (step S218)

[Expression 17]

$$dy = \begin{bmatrix} y\min - \gamma \\ y - y\max \end{bmatrix} \quad (9)$$

[Expression 18]

$$j = \underset{1 \le i \le 2N}{\operatorname{argmax}}(dy[i]). \quad (10)$$

Optimizer 104 then determines whether or not index j of the element to be constrained is larger than N (step S219). When index j of the element to be constrained is equal to or smaller than N (NO in step S219), optimizer 104 sets variable w to "−1" indicating that the element should be constrained to the lower limit (step S214).

When index j of the element to be constrained is larger than N (YES in step S219), optimizer 104 updates index j of the element to be constrained to j−N (step S220) and sets variable w to "1" indicating that the element should be constrained to the upper limit (step S217).

Figure 12:
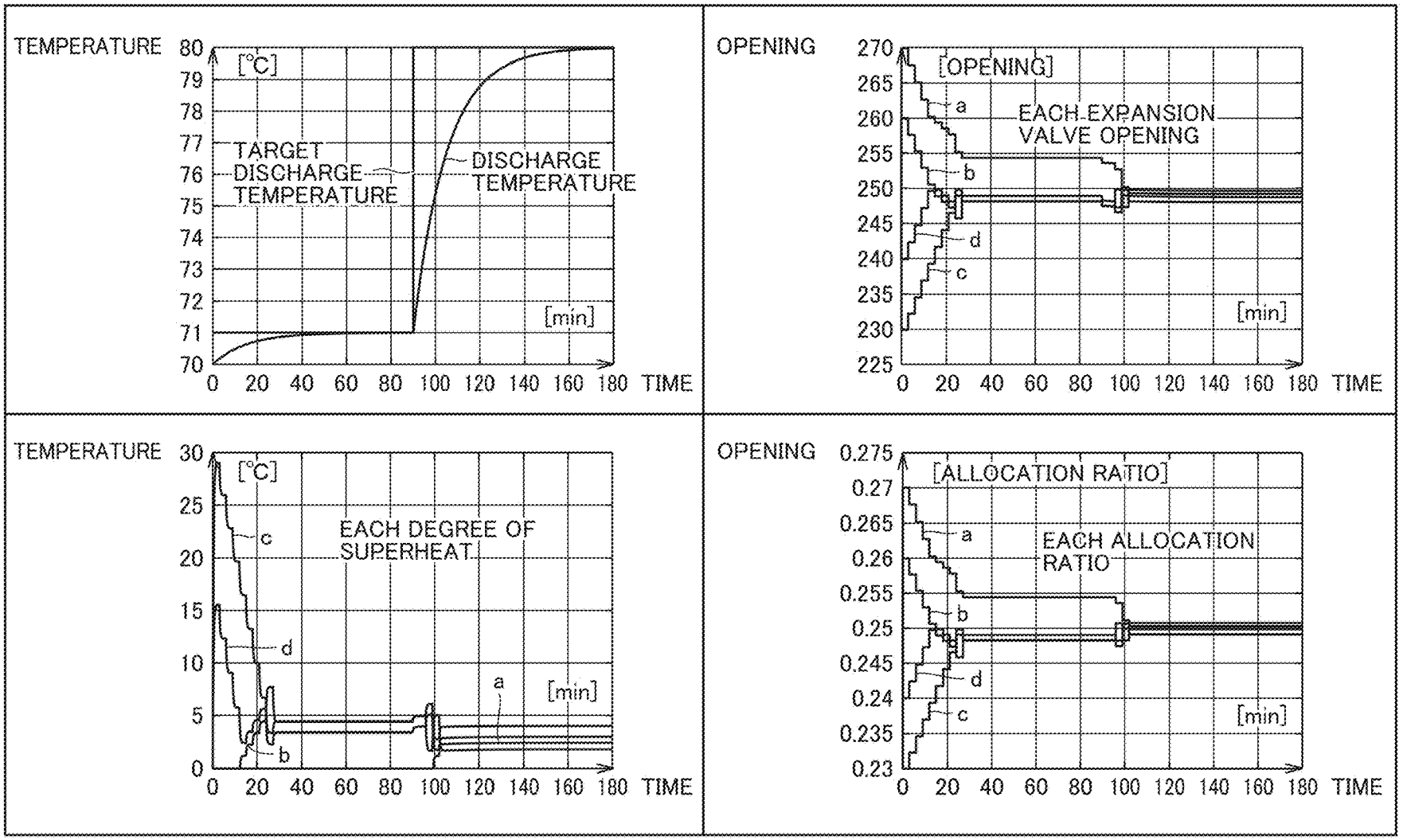
FIG. 12 shows an exemplary result of simulation of a control operation during a cooling operation.

FIG. 12 shows an exemplary result of simulation of a control operation when controller 2 performs the processing during the cooling operation.

An upper left graph in FIG. 12 is a time-series graph of a target discharge temperature and a discharge temperature of compressor 3. Though the discharge temperature is 70° C. and the target discharge temperature is 71° C. at the time of start of simulation, with lapse of time, the discharge temperature converges to target discharge temperature of 71° C. When the target discharge temperature is changed to 80° C. at 90 minutes, with lapse of time, the discharge temperature converges to target discharge temperature 80° C.

A lower left graph in FIG. 12 is a time-series graph of a degree of superheat at an outlet of each of use-side heat exchangers 7*a* to 7*d*. Though the upper limit value of the degree of superheat is set to 5° C. in present simulation, at the time of start of simulation, the degree of superheat of two use-side heat exchangers 7*c* and 7*d* among four use-side heat exchangers 7*a* to 7*d* is higher than the upper limit value of 5° C. With lapse of time, however, all degrees of superheat are not higher than the upper limit value of 5° C. As controller 2 performs the processing above and the openings of expansion valves 6*a* to 6*d* are varied at 90 minutes when the target discharge temperature is changed from 71° C. to 80° C., all degrees of superheat are again suppressed to the upper limit value of 5° C. or lower, although the degree of superheat exceeding the upper limit value of 5° C. is momentarily present.

An upper right graph in FIG. 12 is a time-series graph of the opening of each of expansion valves 6*a* to 6*d*. A lower right graph in FIG. 12 is a time-series graph of an allocation ratio of the openings of expansion valves 6*a* to 6*d*. Though the openings of expansion valves 6*c* and 6*d* of use-side heat exchangers 7*c* and 7*d* where the degree of superheat exceeds the upper limit value of 5° C. at the time of start of simulation relatively increase, the openings of remaining expansion valves 6*a* and 6*b* relatively decrease in conformity, so that the sum of the openings of four expansion valves 6*a* to 6*d* is maintained at total opening St.

As set forth above, controller 2 according to the present disclosure can solve the optimization problem shown in the expression (1) simply by repeating constraint of the solution element and orthogonal projection described above N−1 times at the maximum in an example where "N" elements are to be optimized. Since computation performed by optimizer 104 is only easy four fundamental operations, the optimal solution can be found with high accuracy and with less calculation load. In other words, reduction in size of controller 2 and improvement in control performance owing to a shorter calculation cycle can be achieved. Improvement in control performance means improvement in energy saving performance and comfortability owing to improvement in performance to control the discharge temperature, the degree of superheat, and the degree of supercooling.

The mathematical expression and the calculation technique described in the present embodiment are merely by way of example, and limitation to the mathematical expression and the calculation technique described in the present embodiment is not intended so long as the solution to the optimization problem can be obtained by repetition of constraint of the solution element and orthogonal projection.

<Modification>

Though optimizer 104 according to the embodiment described above obtains the solution to the optimization problem shown in the expression (1) by repeating constraint of the solution element and orthogonal projection, optimizer 104 can obtain the solution to the optimization problem shown in the expression (1) also by performing processing below.

Figure 13:
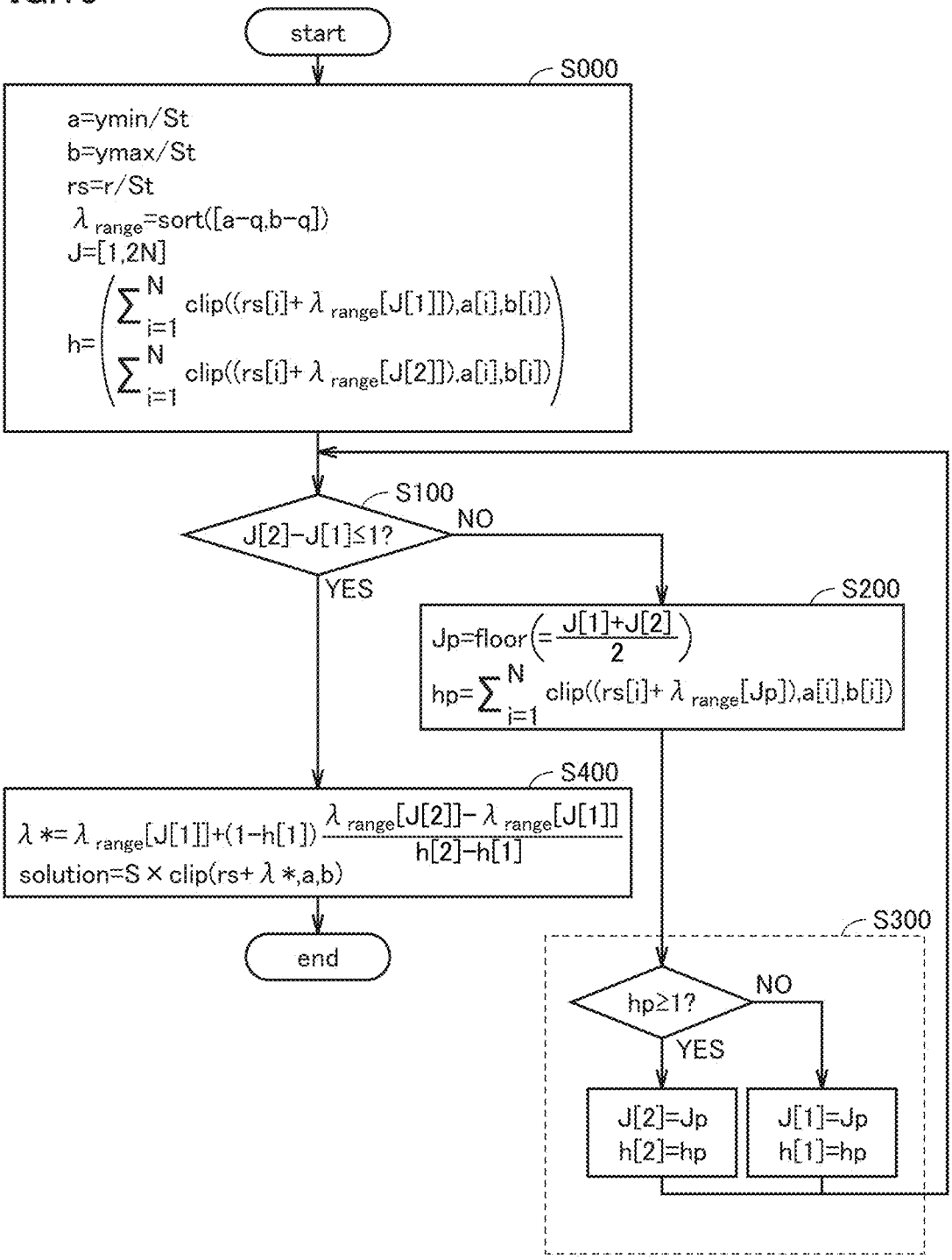
FIG. 13 is a flowchart (No. 2) showing an exemplary procedure of processing by the optimizer.

FIG. 13 is a flowchart showing an exemplary procedure of processing performed by optimizer 104 according to the present modification for efficiently solving the optimization problem shown in the expression (1). In FIG. 13 again, the dimension is set to "N" for generalization.

Initially, in step S000, optimizer 104 performs initialization processing shown in expressions (11) and (12) below

[Expression 19]

$$\left.\begin{aligned} a &= y\min/St \in \mathbb{R}^N \\ b &= y\max/St \in \mathbb{R}^N \\ r_S &= r/St \in \mathbb{R}^N \\ \lambda_{range} &= \mathrm{sort}([a-q,\ b-q]) \\ J &= [1,\ 2N] \end{aligned}\right\} \tag{11}$$

[Expression 20]

$$h = \begin{Bmatrix} \sum_{i=1}^{N} \mathrm{clip}((r_S[i] + \lambda_{range}[J[1]]),\ a[i],\ b[i]) \\ \sum_{i=1}^{N} \mathrm{clip}((r_S[i] + \lambda_{range}[J[2]]),\ a[i],\ b[i]) \end{Bmatrix}. \tag{12}$$

Specifically, optimizer 104 calculates an adjustment lower limit value vector a, an adjustment upper limit value vector b, and an adjustment target opening vector $r_S$ by dividing lower limit value vector ymin, upper limit value vector ymax, and a target opening vector r by total opening St, respectively.

Optimizer 104 then sets as a range vector $\lambda_{range}$, a vector obtained by coupling a vector obtained by subtracting adjustment target opening vector $r_S$ from adjustment lower limit value vector a and a vector obtained by subtracting adjustment target opening vector $r_S$ from adjustment upper limit value vector b and sorting the vectors in an ascending order. "sort" in the expression (11) represents a function for sorting an inputted sequence in the ascending order.

Optimizer 104 then defines as index vector J, a vector having a first element which is 1 and a second element which is twice as large as the number N of use-side heat exchangers. Optimizer 104 then defines an adjustment total range vector h in the expression (12) above.

Then, in step S100, optimizer 104 determines whether or not a value (=J[2]−J[1]) calculated by subtracting a value of a first element J[1] from a value of a second element J[2] of index vector J is equal to or smaller than 1.

When determination as NO is made in step S100, in step S200, optimizer 104 performs processing shown in expressions (13) and (14) below

[Expression 21]

$$J_P = \mathrm{floor}\left(\frac{J[1] + J[2]}{2}\right) \tag{13}$$

[Expression 22]

$$h_P = \sum_{i=1}^{N} \mathrm{clip}((r_S[i] + \lambda_{range}[J_P]),\ a[i],\ b[i]). \tag{14}$$

Specifically, optimizer 104 sets a value obtained by dropping a fractional portion of an average value of index vectors J as a provisional index $J_P$. Optimizer 104 then calculates a provisional adjustment total value $h_P$ in the expression (14) above. "clip" represents a function defined in an expression (15) below

[Expression 23]

$$\mathrm{clip}(x,\ a,\ b) := \min(b,\ \max(x,\ a)). \tag{15}$$

Then, in step S300, optimizer 104 performs processing below. Initially, optimizer 104 determines whether or not provisional adjustment total value $h_P$ is equal to or larger than 1. When provisional adjustment total value $h_P$ is equal to or larger than 1, provisional index $J_P$ is substituted into second element J[2] of index vector J and provisional adjustment total value $h_P$ is substituted into a second element h[2] of adjustment total range vector h. When provisional adjustment total value $h_P$ is smaller than 1, on the other hand, provisional index $J_P$ is substituted into first element J[1] of index vector J and provisional adjustment total value $h_P$ is substituted into a first element h[1] of adjustment total range vector h.

When processing in step S300 ends, optimizer 104 has the process return to step S100. Optimizer 104 repeats processing in steps S200 and 300 until J[2]−J[1] is determined as being equal to or smaller than 1 in step S100.

Then, when J[2]−J[1] is determined as being equal to or smaller than 1 in step S100 (YES in step S100), in step S400, optimizer 104 performs processing shown in expressions (16) and (17) below

[Expression 24]

$$\lambda^* = \lambda_{range}[J[1]] + (1 - h[1])\frac{\lambda_{range}[J[2]] - \lambda_{range}[J[1]]}{h[2] - h[1]} \tag{16}$$

[Expression 25]

$$\mathrm{solution} = S \times \mathrm{clip}(r_S + \lambda^*,\ a,\ b). \tag{17}$$

Specifically, optimizer 104 calculates a Lagrange multiplier $\lambda^*$ in accordance with the expression (16). Optimizer 104 then outputs an optimal solution calculated in the expression (17).

Processing according to the present modification outputs the solution that satisfies a Karush-Kuhn-Tucker condition (KKT condition), and ensures output of the optimal solution for convexity of the problem. Even when the sum of target openings Sm (=Sm1, Sm2, . . . ) of the expansion valves is not equal to total opening St, the optimal solution can be found. Furthermore, the optimal solution can be found by calculation repeated "ceil(log 2(N)+1)" times at the maximum. "ceil" means rounding up to an integer.

Processing according to the present first modification is performed to determine an optimal Lagrange multiplier by sorting and a bisection method to output the optimal solution. More specifically, in the present optimization problem, the Lagrange multiplier and a feasible solution Si as well as the fact that the sum of the Lagrange multiplier and feasible solution Si are piecewise linear are used to find, by sorting and the bisection method, an end point of a piecewise linear function including a point where an optimal Lagrange multiplier is present and to find a point where equal constraint on the piecewise linear function is satisfied, to thereby determine the point where the KKT condition is satisfied. The mathematical expression and the calculation technique described in the present first modification are merely by way of example and limitation thereto is not intended.

It should be understood that the embodiment disclosed herein is illustrative and non-restrictive in every respect. The scope of the present disclosure is defined by the terms of the claims rather than the description above and is intended to include any modifications within the scope and meaning equivalent to the terms of the claims.

REFERENCE SIGNS LIST

1 refrigeration cycle apparatus; 2 controller; 2, 11, 12, 13*a* to 13*d*, 14*a* to 14*d*, 17 temperature sensor; 3 compressor; 4 four-way valve; 5 heat-source-side heat exchanger; 6*a* to 6*d* expansion valve; 7*a* to 7*d* use-side heat exchanger; 15, 16, 17 pressure sensor; 21 control processor; 22 time counter; 23 storage; 101 total opening computing unit; 102 target opening computing unit; 103 restricted opening setting unit; 104 optimizer

The invention claimed is:

1. A refrigeration cycle apparatus comprising:

a refrigerant circuit including a compressor, a heat-source-side heat exchanger, a plurality of expansion valves connected in parallel to the heat-source-side heat exchanger, and a plurality of use-side heat exchangers connected in series to the plurality of expansion valves, respectively; and a controller to control the plurality of expansion valves such that openings of the plurality of expansion valves are set to a plurality of opening command values, respectively, wherein the controller has a total computing unit to compute a total opening of the plurality of expansion valves, a target computing unit to compute a plurality of target openings representing respective target values of openings of the plurality of expansion valves, a restriction setting unit to set a plurality of restricted ranges defined by lower limit values and upper limit values of the openings of the plurality of expansion valves, respectively, and an optimizer to set the plurality of opening command values by using the total opening, the plurality of target openings, and the plurality of restricted ranges, the target computing unit computes the plurality of target openings such that a total of the plurality of target openings is equal to the total opening, the optimizer in an initial step, sets the plurality of target openings to a plurality of provisional openings, respectively, in a first step, determines whether an inequality constraint is satisfied, the inequality constraint being that each of the plurality of provisional openings is within a corresponding restricted range, when the inequality constraint is not satisfied, in a second step, computes an upper limit excess indicator and a lower limit excess indicator and compares the upper limit excess indicator and the lower limit excess indicator with each other, the upper limit excess indicator indicating a degree of excess over the upper limit values of the plurality of provisional openings, the lower limit excess indicator indicating a degree of excess over the lower limit values of the plurality of provisional openings, and fixes a provisional opening which deviates most from a limit value larger in indicator as an upper limit value or a lower limit value of the provisional opening, in a third step, sets again as the plurality of provisional openings, points obtained by orthogonally projecting points representing the plurality of provisional openings on an affine hyperplane in a space reduced in order by exclusion of an already fixed provisional opening from the plurality of provisional openings, the affine hyperplane having as an intercept, a subtraction total opening calculated by subtracting the already fixed provisional opening from the total opening, and returns to the first step, repeats processing from the first step to the third step until the inequality constraint is satisfied, and when the inequality constraint is satisfied, in a fourth step, sets the plurality of provisional openings at time when the inequality constraint is satisfied, as the plurality of opening command values, respectively.

2. A refrigeration cycle apparatus comprising:

a refrigerant circuit including a compressor, a heat-source-side heat exchanger, a plurality of expansion valves connected in parallel to the heat-source-side heat exchanger, and a plurality of use-side heat exchangers connected in series to the plurality of expansion valves, respectively; and a controller to control the plurality of expansion valves such that openings of the plurality of expansion valves are set to a plurality of opening command values, respectively, wherein the controller has a total computing unit to compute a total opening of the plurality of expansion valves, a target computing unit to compute a plurality of target openings representing respective target values of openings of the plurality of expansion valves, a restriction setting unit to set a plurality of upper limit openings representing respective upper limit values of the openings of the plurality of expansion valves and a plurality of lower limit openings representing respective lower limit values of the openings of the plurality of expansion valves, and an optimizer to set the plurality of opening command values by using the total opening, the plurality of target openings, the plurality of upper limit openings, and the plurality of lower limit openings, the target computing unit computes the plurality of target openings such that a total of the plurality of target openings is equal to the total opening, the optimizer in an initial step, calculates an adjustment lower limit value vector a, an adjustment upper limit value vector b, and an adjustment target value vector $r_S$ by dividing a lower limit value vector having the plurality of lower limit openings as elements, an upper limit value vector having the plurality of upper limit openings as elements, and a target value vector having the plurality of target openings as elements by the total opening, respectively, sets as a range vector $\lambda_{range}$, a vector obtained by coupling a vector calculated by subtracting the adjustment target value vector $r_S$ from the adjustment lower limit value vector a and a vector calculated by subtracting the adjustment target value vector $r_S$ from the adjustment upper limit value vector b and sorting the vectors in an ascending order, sets as an index vector J, a vector having a first element which is 1 and a second element which is twice as large as the number N of the plurality of expansion valves, and defines an adjustment total range vector h in an expression (12) below

[Expression 1]

$$h = \begin{Bmatrix} \sum_{i=1}^{N} \mathrm{clip}((r_S[i] + \lambda_{range}[J[1]]), a[i], b[i]) \\ \sum_{i=1}^{N} \mathrm{clip}((r_S[i] + \lambda_{range}[J[2]]), a[i], b[i]) \end{Bmatrix}, \quad (12)$$

in a first step, determines whether J[2]–J[1] is equal to or smaller than 1, J[2]–J[1] being a value calculated by subtracting a value of a first element J[1] from a value of a second element J[2] of the index vector J, when J[2]–J[1] is not equal to or smaller than 1, in a second step, sets as a provisional index $J_P$, a value calculated by dropping a fractional portion of an average value of index vectors J and calculates a provisional adjustment total value $h_P$ in an expression (14) below

[Expression 2]

$$h_P = \sum_{i=1}^{N} \mathrm{clip}((r_S[i] + \lambda_{range}[J_P]), a[i], b[i]), \quad (14)$$

in a third step, determines whether the provisional adjustment total value $h_P$ is equal to or larger than 1, when the provisional adjustment total value $h_P$ is equal to or larger than 1, substitutes the provisional index $J_P$ into the second element J[2] of the index vector J, substitutes the provisional adjustment total value $h_P$ into a second element h[2] of the adjustment total range vector h, and returns to the first step, and when the provisional adjustment total value $h_P$ is not equal to or larger than 1, substitutes the provisional index $J_P$ into the first element J[1] of the index vector J, substitutes the provisional adjustment total value $h_P$ into a first element h[1] of the adjustment total range vector h, and returns to the first step, repeats processing from the first step to the third step until J[2]–J[1] becomes equal to or smaller than 1, and when J[2]–J[1] becomes equal to or smaller than 1, in a fourth step, calculates a Lagrange multiplier λ* in an expression (16) below

[Expression 3]

$$\lambda^* = \lambda_{range}[J[1]] + (1 - h[1])\frac{\lambda_{range}[J[2]] - \lambda_{range}[J[1]]}{h[2] - h[1]}, \quad (16)$$

and sets an optimal solution calculated in an expression (17) below as the plurality of opening command values

[Expression 4]

$$\mathrm{solution} = S \times \mathrm{clip}(r_S + \lambda^*, a, b). \quad (17)$$

3. An optimization method causing, when a total value, a restriction vector including an upper limit value and a lower limit value, and a target value vector of which total of elements is equal to the total value are given to a computer or computed by internal computation by the computer, the computer to perform processing comprising:

in an initial step, setting a provisional value vector as the target value vector;

in a first step, determining whether an inequality constraint is satisfied, the inequality constraint being that the provisional value vector is within a restricted range defined by the restriction vector;

when the inequality constraint is not satisfied, in a second step, computing an upper limit excess indicator and a lower limit excess indicator and comparing the upper limit excess indicator and the lower limit excess indicator with each other, the upper limit excess indicator indicating a degree of excess over an upper limit value of an element of the provisional value vector, the lower limit excess indicator indicating a degree of excess over a lower limit value of the element of the provisional value vector, and fixing an element which deviates most from a limit value larger in indicator to the upper limit value or the lower limit value of the element;

in a third step, setting again as the target value vector, a point obtained by orthogonally projecting a point representing the provisional value vector on an affine hyperplane in a space reduced in order by exclusion of an already fixed element from the provisional value vector, the affine hyperplane having as an intercept, a subtraction total value calculated by subtracting the already fixed element from the total value, and returning to the first step;

repeating processing from the first step to the third step until the inequality constraint is satisfied; and when the inequality constraint is satisfied, in a fourth step, outputting as a solution vector, the provisional value vector at time when the inequality constraint is satisfied, and quitting.

4. An optimization method causing, when a total value, an upper limit value vector, a lower limit value vector, and a target value vector of which total of elements is equal to the total value are given to a computer or computed by internal computation by the computer, the computer to perform processing comprising:

in an initial step, calculating an adjustment lower limit value vector a, an adjustment upper limit value vector b, and an adjustment target value vector $r_S$ by dividing the lower limit value vector, the upper limit value vector, and the target value vector by the total value, respectively, setting as a range vector $\lambda_{range}$, a vector obtained by coupling a vector calculated by subtracting the adjustment target value vector $r_S$ from the adjustment lower limit value vector a and a vector calculated by subtracting the adjustment target value vector $r_S$ from the adjustment upper limit value vector b and sorting the vectors in an ascending order, setting as an index vector J, a vector having a first element which is 1 and a second element which is twice as large as the number N of elements of the target value vector, and defining an adjustment total range vector h in an expression (12) below

[Expression 5]

$$h = \begin{Bmatrix} \sum_{i=1}^{N} \mathrm{clip}((r_S[i] + \lambda_{range}[J[1]]), a[i], b[i]) \\ \sum_{i=1}^{N} \mathrm{clip}((r_S[i] + \lambda_{range}[J[2]]), a[i], b[i]) \end{Bmatrix}; \quad (12)$$

in a first step, determining whether J[2]–J[1] is equal to or smaller than 1, J[2]–J[1] being a value calculated by subtracting a value of a first element J[1] from a value of a second element J[2] of the index vector J;

when J[2]–J[1] is not equal to or smaller than 1, in a second step, setting as a provisional index $J_P$, a value calculated by dropping a fractional portion of an average value of index vectors J and calculating a provisional adjustment total value $h_P$ in an expression (14) below

[Expression 6]

$$h_P = \sum_{i=1}^{N} \mathrm{clip}((r_S[i] + \lambda_{range}[J_P]), a[i], b[i]), \quad (14)$$

in a third step, determining whether the provisional adjustment total value $h_P$ is equal to or larger than 1, when the provisional adjustment total value $h_P$ is equal to or larger than 1, substituting the provisional index $J_P$ into the second element J[2] of the index vector J, substituting the provisional adjustment total value $h_P$ into a second element h[2] of the adjustment total range vector h, and returning to the first step, and when the provisional adjustment total value $h_P$ is not equal to or larger than 1, substituting the provisional index $J_P$ into the first element j[1] of the index vector J, substituting the provisional adjustment total value $h_P$ into a first element h[1] of the adjustment total range vector h, and returning to the first step;

repeating processing from the first step to the third step until J[2]–J[1] becomes equal to or smaller than 1; and when J[2]–J[1] becomes equal to or smaller than 1, in a fourth step, calculating a Lagrange multiplier λ* in an expression (16) below

[Expression 7]

$$\lambda^* = \lambda_{range}[J[1]] + (1 - h[1])\frac{\lambda_{range}[J[2]] - \lambda_{range}[J[1]]}{h[2] - h[1]}, \quad (16)$$

and outputting a vector calculated in an expression (17) below as a solution vector and quitting

[Expression 8]

$$\mathrm{solution} = S \times \mathrm{clip}(r_S + \lambda^*, a, b). \quad (17)$$

* * * * *